US006812901B2

(12) United States Patent
Deininger

(10) Patent No.: US 6,812,901 B2
(45) Date of Patent: Nov. 2, 2004

(54) ANTENNA ARRANGEMENT FOR A VEHICLE

(75) Inventor: Juergen Deininger, Weil der Stadt (DE)

(73) Assignee: DaimlerChrysler AG, Stuttgart (DE)

( * ) Notice: Subject to any disclaimer, the term of this patent is extended or adjusted under 35 U.S.C. 154(b) by 0 days.

(21) Appl. No.: 10/206,795

(22) Filed: Jul. 29, 2002

(65) Prior Publication Data

US 2003/0034927 A1 Feb. 20, 2003

(30) Foreign Application Priority Data

Jul. 30, 2001 (DE) ..... 101 37 019

(51) Int. Cl.[7] ..... H01Q 1/32
(52) U.S. Cl. ..... 343/713; 343/725; 343/876
(58) Field of Search ..... 343/711, 712, 343/713, 725, 876, 893

(56) References Cited

U.S. PATENT DOCUMENTS 4,845,505 A * 7/1989 Ohe et al. ..... 343/712
5,675,347 A * 10/1997 Terashima et al. ..... 343/713
6,057,803 A * 5/2000 Kane et al. ..... 343/713
6,215,450 B1 * 4/2001 Oka ..... 343/713
6,310,580 B2 * 10/2001 Taniguchi et al. ..... 343/713
6,377,221 B1 * 4/2002 Lindenmeier et al. ..... 343/713

FOREIGN PATENT DOCUMENTS

| | | |
|---|---|---|
| DE | 195 35 250 A1 | 9/1995 |
| DE | 295 21 512 U1 | 6/1997 |
| DE | 199 28 213 C1 | 6/1999 |
| EP | 0 269 723 B1 | 6/1987 |

* cited by examiner

*Primary Examiner*—Shih-Chao Chen
(74) *Attorney, Agent, or Firm*—Crowell & Moring LLP

(57) ABSTRACT

An antenna arrangement for a vehicle comprises a plurality of individual antennas, at least one of which is arranged in a vehicle window. The vehicle has a cover unit for a free space between the window and a region in the vehicle interior, which cover unit comprises a metal body that forms a further antenna. A switching device controls switching between the antennas to optimize signal reception.

11 Claims, 3 Drawing Sheets

ANTENNA ARRANGEMENT FOR A VEHICLE

BACKGROUND AND SUMMARY OF THE INVENTION

This application claims the priority of German patent document 101 37 019.9, filed Jul. 30, 2001, the disclosure of which is expressly incorporated by reference herein.

The invention relates to an antenna arrangement for a vehicle, particularly a multi-antenna arrangement.

To secure against theft and vandalism, and to improve the aerodynamics of the vehicle, conventional rod antennas for broadcast radio reception are frequently dispensed with in favor of incorporating antennas into the vehicle's windshield or in a window (e.g., in the form of a rear window heating panel or in the form of separate antennas in the windshield and the rear window.) For example, German patent documents DE 295 21 512 U1 and EP 0 269 723 B1 disclose various diversity antenna arrangements which comprise a plurality of diversity antennas in the area of the windshield in order to improve broadcast radio reception. German patent document DE 195 35 250 A1, on the other hand, discloses the use of metal antenna structures arranged in plastic parts, e.g., the rear cover, of the vehicle bodywork.

In addition, particularly in convertibles, reversible characteristics of the windows, particularly the rear window, mean that antennas can be used only in the windshield or in the form of a rod antenna. For visual reasons, the rod antenna needs to be avoided. The windshield antenna and the antennas arranged in plastic parts are correspondingly complex and cost-intensive for reasons of electromagnetic compatibility (EMC).

One object of the invention, therefore, is to simplify the design and actuation of an antenna arrangement for a vehicle having a plurality of antennas.

This and other objects and advantages are achieved by the antenna arrangement according to the invention, which has an antenna arranged in a screen and a further antenna formed from a metal body and incorporated in a cover unit between the screen and a region in the vehicle interior. This antenna arrangement provides a diversity antenna which is of mechanically simple form and can be incorporated in a particularly simple manner. It is also subject to particularly little wear and is particularly maintenance-free. In addition, the antenna arrangement is arranged invisibly, so that neither the visual characteristics nor the aerodynamics of the vehicle are impaired. The cover unit used in this context is preferably a parcel shelf, so that no additional physical space is required for the antenna. Instead, existing components—windshield and parcel shelf—are used for such a diversity antenna arrangement for the vehicle. This ensures that the antenna arrangement can easily be fitted subsequently in existing vehicles.

Particularly for a vehicle with an adjustable vehicle roof where the antenna incorporated in a rear window (and hence in the region of the adjustable vehicle roof) is arranged, in the open position, in a hood, a switching device is expediently provided for changing over between the antenna incorporated in the window and the antenna incorporated in the cover unit depending on the degree of opening of an adjustable vehicle roof. In this case, when the vehicle roof is in the closed position (top up), the antenna incorporated in the rear screen is activated for signal reception. When the vehicle roof is in the open or top down position, with the rear screen in the boot hood, the switching device is used to activate the antenna in the cover unit.

Preferably, the cover unit is designed so as to be DC-isolated from the bodywork of the vehicle. That is to say that the cover unit or parcel shelf is formed from a metal part which is isolated from the vehicle bodywork. (E.g., it may be formed from a die-cast magnesium part.) This allows the whole parcel shelf to be used as an antenna.

Advantageously, the antenna formed by the cover unit is provided for broadcast radio reception in the AM range. Expediently, the antenna arranged in the window comprises a multi-antenna arrangement, and is provided for broadcast radio reception in the AM range, as well. This means that a combination of the antenna in the cover unit and the multi-antenna arrangement in the window forms a multiple diversity antenna for the AM range.

To improve the reception response for such multipath reception, the antennas each have an associated separate antenna amplifier which is arranged close to the antenna. Preferably, the cover unit is connected by means of a braid to one input of the relevant antenna amplifier grounded to the vehicle body.

Depending on the type and function of communications services and/or media provided in the vehicle, further antennas can be provided, either alternatively or additionally, in the same window or in another window, for broadcast radio reception in the FM range and/or for receiving a GPS signal. In this case, a further multi-antenna arrangement is provided in the region of the front windshield for reception in the FM/TV range. Expediently, a further switching device is provided for changing over between the antennas receiving the FM/TV range.

Depending on the quality of the reception, the switching device can be in the form of a simple switching element or in the form of a diversity processor. In this case, the conventional switching element involves changing over one antenna to another antenna when the received signal drops below a prescribed minimum. The diversity processor is used to perform an improved selection procedure, in which a continual quality comparison between the receiving antennas is used to select the optimum antenna in each case.

To coordinate the various switching devices for the respective multi-antenna arrangement—FM multi-antenna arrangement and AM multi-antenna arrangement—and also other reception antennas, such as GPS antenna, telephone antenna, emergency-call antenna, the vehicle has a control and operating unit for controlling and/or operating the switching devices. Advantageously, the control and operating unit is connected to a control unit for the adjustable vehicle roof by means of a bus system. This ensures that vehicle-related data are taken into account when controlling and/or operating the antenna arrangement. Depending on the type and form, the control and operating unit can be part of the radio or of another system.

Other objects, advantages and novel features of the present invention will become apparent from the following detailed description of the invention when considered in conjunction with the accompanying drawings.

DETAILED DESCRIPTION OF THE INVENTION

Mutually corresponding parts have been provided with the same reference symbols in all the figures.

Figure 1:
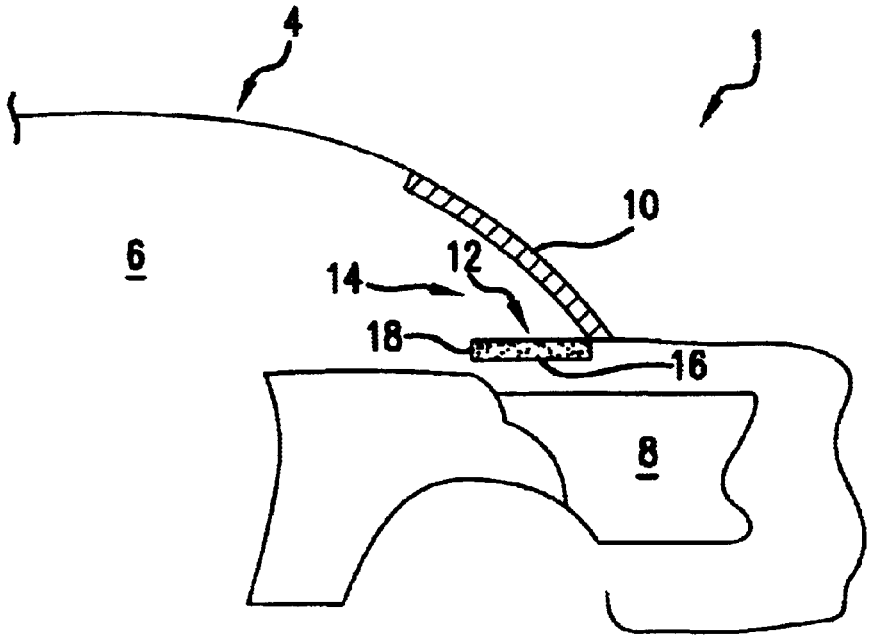
FIG. 1 is a schematic side view of a vehicle having an adjustable vehicle roof in the closed position, and a cover unit in the form of a parcel shelf.

FIG. 1 shows schematically a side view of a rear region 1 of a vehicle 2 having an adjustable vehicle roof 4, which is shown in the closed position (covering a vehicle interior 6). When the vehicle roof 4 is in the open position, it is retracted in a hood case 8 at the back. The adjustable vehicle roof 4 is a hardtop having two, possibly even three, cohesive, inherently rigid roof parts which are packed above one another in the hood case 8 in the open or stowed position. Alternatively, the vehicle roof 4 may also be a softtop having a hood linkage and a hood covering material held by the hood linkage.

In addition, the vehicle roof 4 incorporates a rear window 10 towards the rear region 1. The hood case 8 is arranged in the rear region 1 of the vehicle 2 below the rear window 10 and adjoins the vehicle interior 6 at the rear.

In addition, a cover unit 12, which is in the form of a parcel shelf and may be adjustable, is arranged in a free space 14 between the rear window 10 and a rear region of the vehicle interior 6. The cover unit 12 comprises a metal body 16. Alternatively, the whole cover unit 12 is of metal form, particularly in the form of a die-cast magnesium component, and is electrically isolated from all adjoining components, particularly from the body components and roof components on which it is held. Its metal form and electrical isolation from adjoining components allow the cover unit 12 to be used as an antenna 18. For diversity reasons, a further antenna 20 is incorporated in the rear window 10.

In this case, the antennas 18 and 20 in the cover unit 12 and in the rear screen 10 are designed such that, in the open state of the vehicle roof 4 (i.e., it is packed in the hood case 8 with the rear window 10 and hence with the incorporated antenna 20), the antenna 18 in the cover unit 12 is selected. On the other hand, when the vehicle roof 4 is in the closed position and covers the vehicle interior 6 (and hence also the cover unit 12), the antenna 20 in the rear screen 10 is selected.

Figure 2:
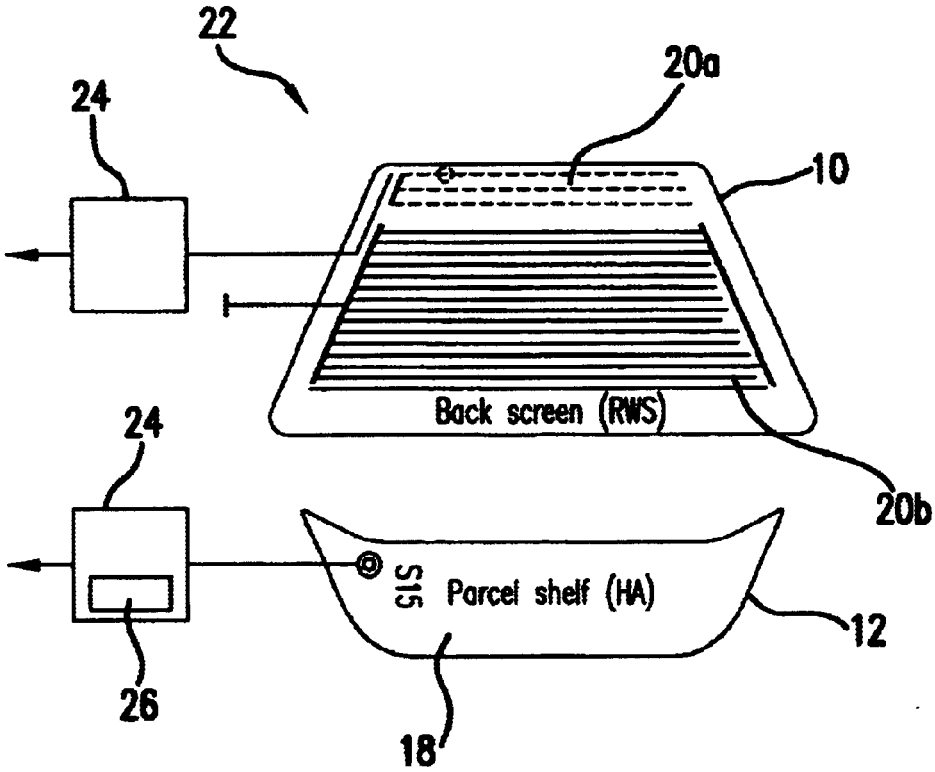
FIG. 2 is a schematic depiction of an antenna arrangement having at least antennas incorporated in a window and in a cover unit.

FIG. 2 shows an antenna arrangement 22 which includes antennas 18 and 20. Depending on the type and form, the antenna 20 can in this case be a multiple antenna arrangement having individual antennas 20*a*, 20*b*. The antenna 18 is formed by the metal of the cover unit 12. The antennas 18, 20, 20*a*, 20*b* can be provided for broadcast radio reception in the AM/FM range and/or for television reception. The antennas 18, 20, 20*a* and 20*b* each have an associated antenna amplifier 24 which is arranged as close as possible to the antenna. In the case of the antenna 20 incorporated in the rear window 10 and its individual antennas 20*a*, 20*b*, the antenna amplifier 24 is arranged in the region of the rear screen 10. The antenna amplifier 24 for the cover unit 12 is arranged close to the antenna in the region of the cover unit 12 on a bodywork part. The relevant antenna 18 is in this case connected to the input of the associated antenna amplifier 24 by means of a braid.

Change over between the antenna 18 and the antenna 20 is performed by a switching device 26, which may be, for example, a simple switching element, (e.g., a relay), or a diversity processor. In this case, the switching device 26 can be part of one of the antenna amplifiers 24.

The switching device 26 changes over the antennas depending on the degree of opening of the adjustable vehicle roof 4. In this case, the switching device 26 turns on the antenna 18 in the cover unit 12 when the vehicle roof 4 has been put into the hood case 8. When the vehicle roof 4 is closed (i.e., the vehicle interior 6 has been covered by means of the vehicle roof 4), the switching device 26 is used to select the antenna 20.

Figure 3:
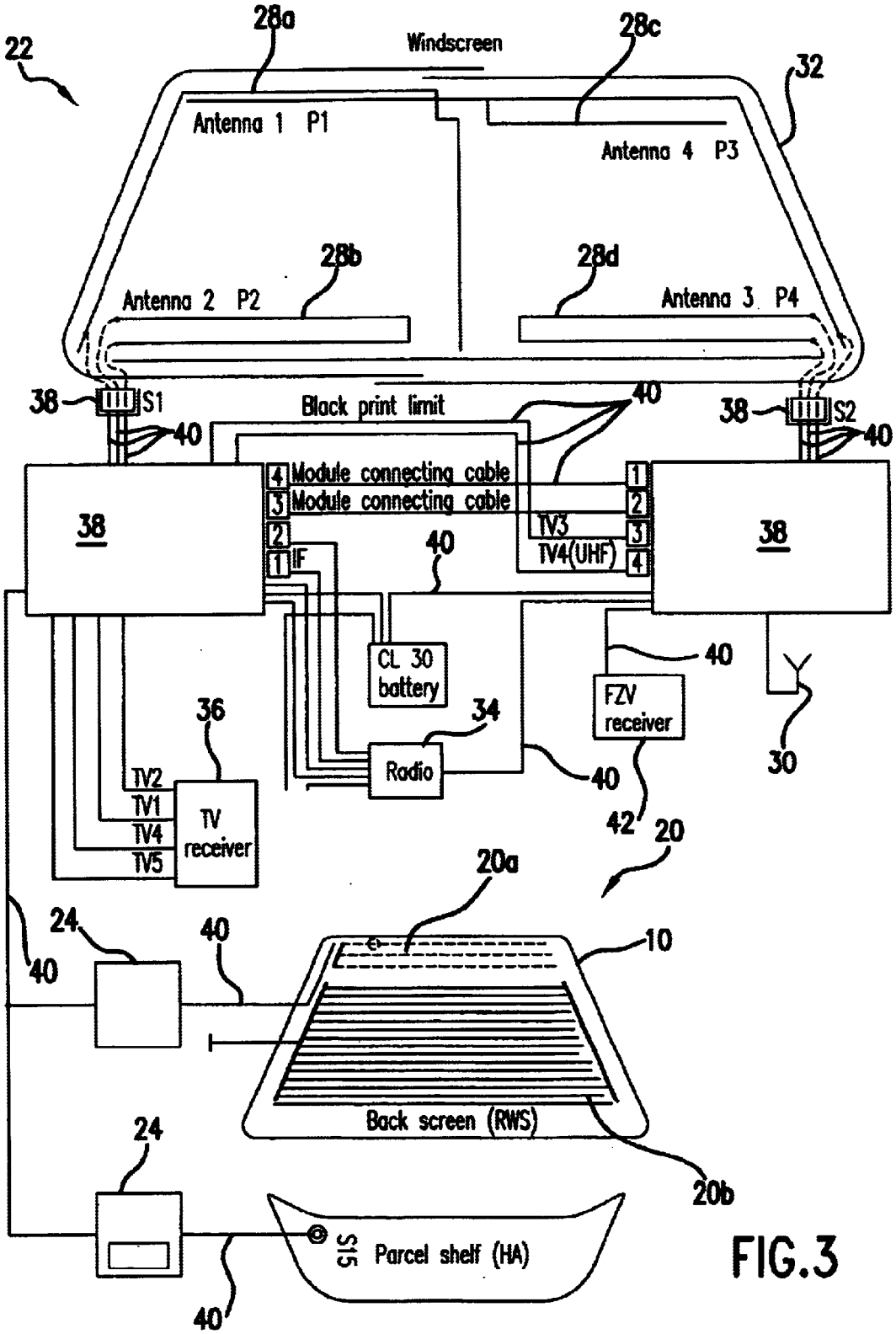
FIG. 3 shows schematically an antenna arrangement as shown in FIG. 2, having further antennas for further communications services.

FIG. 3 shows the antenna arrangement 22 with further antennas 28*a* to 28*d* and 30 for broadcast radio reception in the FM range and for television reception or for emergency-call reception. The antennas 28*a* to 28*d* are diversity antennas which are arranged at various positions P1 to P4 in the region of a front window 32, (e.g., top and bottom left and top and bottom right in the direction of travel). For connecting the relevant antennas 18, 20*a*, 20*b* and 28*a*–28*d* for AM reception or for FM reception/TV reception, their different positioning in the vehicle 2 and their joint use (e.g., radio receiver 34 and television receiver 36), require that a number of connecting elements 38 and connecting lines 40 must be provided. The antenna 30 is an emergency-call antenna which is arranged, for example, in the region of a roll bar (not shown); it is connected to an emergency-call receiver 42 by means of one of the connecting elements 38 via an associated connecting line 40. Depending on the type and form of the antenna arrangement 22, further antennas can be provided for other communications services and/or media.

Figure 4:
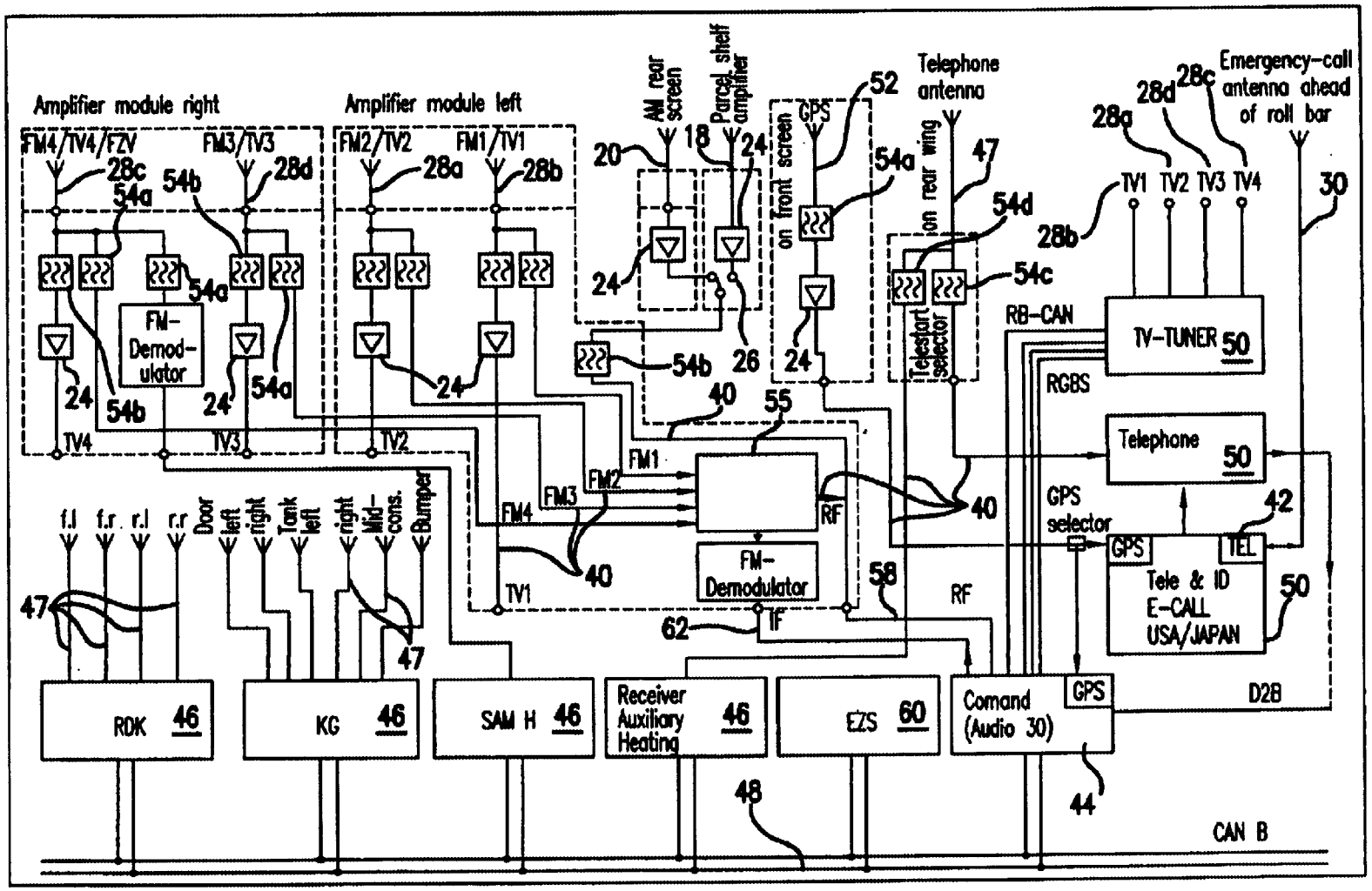
FIG. 4 is a schematic block diagram of a control and operating unit for the antenna arrangement of FIG. 3.

FIG. 4 shows a basic circuit diagram of the antenna arrangement 22 with a control and operating unit 44 for other communications services and/or media and their systems. In this case, the control and operating unit 44 is supplied with further reception data D from further reception systems 46 having associated antennas 47, such as a telephone antenna on a rear wing, a distance radar, a driving authorization system, and an electronic ignition lock, via a bus system 48, particularly a CAN bus. In this case, the control and operating unit 44 is a "command system" to which further data from vehicle-specific communications services and/or media 50 are supplied via the bus system 48 or via a single connection. In addition, a further GPS antenna 52 incorporated in the front screen 32 can be used to supply data D directly to the control and operating unit 44 from a control center, e.g. from a traffic control center.

Depending on the type and design of the antenna arrangement 22, the antennas 18, 20, 28*a* to 28*d*, 30, 47 and 52 can have a separate and hence associated antenna amplifier 24. In addition, depending on specifications, further antenna elements can be provided, e.g., filters in the form of a bandpass filter 54*a*, a band rejection filter 54*b*, a high-pass filter 54*c* and/or a low-pass filter 54*d*.

The switching device 26 may be arranged, for example, in the amplifier 24 for the antenna 18 in the cover unit 12. To change over between the antennas 28*a* to 28*d* receiving the FM range and the TV range, a further switching device 56 is provided, which is in the form of a diversity processor, in particular. The signals selected from the relevant antennas 18, 20 and 28*a* to 28*d* by means of the switching devices 26 and 56 are supplied via the lines 40 to a common line 58 which ends in the control and operating unit 44. The control and operating unit 44 is additionally connected to a roof control unit 60 via the bus system 48.

During operation of the vehicle 2, the two AM antennas 18 and 20 and also the FM/TV antennas 28*a* to 28*d* are selected in the following manner by means of the control and operating unit 44 using the relevant switching device 26 or 56:

First, the control and operating unit 44 is used to monitor which of the AM and FM reception modes has been set on the radio. Depending on which mode has been set, the control and operating unit 44 generates a signal or control command on an output line 62 to turn the relevant antenna amplifier 24 on or off. For example, in the case of a signal of U=0V AM reception is turned on by means of the relevant antenna amplifier 24, and FM/TV reception is turned off by means of the switching device 56. Correspondingly, when U=12V AM reception is turned off and FM/TV reception is turned on. In addition, when AM reception has been turned off, the signal of U=12V is used for diagnostic purposes on the associated output line 62.

If the control and operating unit 44 has set AM reception, it is also used to query the degree of opening of the vehicle roof 4 from the roof control unit 60 via the data bus 48. In this case, to actuate the switching device 26, the information "roof open", "mid-position" or "roof closed" is read from the roof control unit 60. With the information "roof open" (open position of the vehicle roof 4) from the roof control unit 60, and the operating mode AM reception having been set, the switching device 26 is used to select the antenna 18 in the cover unit 12, i.e. the parcel shelf. If the operating mode AM reception has been turned on and the information "roof closed" (closed position of the vehicle roof 4) is provided, then the switching device 26 is used to select the antenna 20 in the rear screen 10. For reasons of compatibility, the information is also on the antenna control line of the radio 34.

By way of example, for AM reception, the following intermediate voltages representing the information are provided for connecting the relevant antenna 10 or 20 depending on the degree of the open position of the vehicle roof 4:

| | | |
|---|---|---|
| Case A: "roof open" | antenna amplifier on: | $U_S > U_B * 0.8$ |
| Case B: "roof closed" | antenna amplifier on: | $0.6 * U_B > U_S > 0.4 * U_B$ |
| Case C: | antenna amplifier off: | $U_S > 0.2 * U_B$ |

where $U_S$ = control voltage and $U_B$ = battery voltage.

In other words: depending on the voltage level, the switching device 26 is used to turn on the relevant antenna 18 (case A) or 20 (case B). If there is severe interference while the roof is being operated, (i.e., with the available information "roof mid-position"), it may be necessary to turn off AM reception for EMC reasons.

By contrast, for the operating mode FM/TV reception, AM reception is turned off and the switching device 56 is used to select the antenna 28*a* to 28*d* which has the best reception quality for FM/TV reception using a diversity processor. Depending on the type and form of the switching device 56, it is also possible to transmit a summed signal, formed from the antennas 28*a* to 28*d*, to the common line 58 for the radio receiver's control and operating unit 44.

The foregoing disclosure has been set forth merely to illustrate the invention and is not intended to be limiting. Since modifications of the disclosed embodiments incorporating the spirit and substance of the invention may occur to persons skilled in the art, the invention should be construed to include everything within the scope of the appended claims and equivalents thereof.

What is claimed is:

1. An antenna arrangement for a vehicle having a plurality of individual antennas, said antenna arrangement comprising:

at least a first antenna arranged in a window of the vehicle;

a second antenna; and a metal cover unit which covers a free space between the vehicle window and a region in the vehicle interior; wherein the metal cover unit is formed by the second antenna; and the antenna arrangement further comprises a switching device for changing over between the first and second antennas, depending on a degree of opening of an adjustable vehicle roof.

2. The antenna arrangement according to claim 1, wherein the switching device comprises one of a simple switching element and a diversity processor.

3. The antenna arrangement according to claim 1, wherein the vehicle has a control and operating unit for controlling operation of the switching device.

4. The antenna arrangement according to claim 3, wherein the control and operating unit is connected to a control unit for the adjustable vehicle roof by means of a bus system.

5. An antenna arrangement for a vehicle, comprising:

at least one first antenna disposed in a window of the vehicle;

a second antenna formed by a metallic cover unit which forms a part of interior trim of the vehicle; and switching means for switching between said first and second antennas to optimize signal reception.

6. The apparatus according to claim 5, wherein:

said vehicle has an adjustable roof which is movable between a closed position and a storage position; and said metallic cover unit comprises an interior ledge in a rear portion of said vehicle, which faces an open space opposite said vehicle window when the roof is in the closed position.

7. The apparatus according to claim 6, wherein:

said vehicle includes means for determining a position of the vehicle roof; and said switching means switches between said first and second antennas as a function of determined position of the vehicle roof.

8. A vehicle, comprising:

a vehicle body having an interior passenger compartment bounded at least partially by vehicle windows;

at least one first antenna disposed in a vehicle window; and a shelf for storage of articles in interior of the vehicle;

wherein the shelf comprises a metallic body, and forms a second antenna; and means are provided for switching between the first and second antennas to optimize signal reception.

9. The vehicle according to claim 8, wherein the shelf comprises a rear window ledge of the vehicle.

10. The vehicle according to claim 8, wherein:

said vehicle has an adjustable roof which is movable between a closed position and a storage position; and said shell comprises an interior ledge in a rear portion of said vehicle, which faces an interior open space opposite said vehicle window when the roof is in the closed position.

11. The vehicle according to claim 10, wherein said shelf comprises a rear window ledge of the vehicle.

* * * * *